US005804075A

United States Patent [19]

Aikawa

[11] Patent Number: 5,804,075

[45] Date of Patent: Sep. 8, 1998

[54] PAPERMAKING SCREEN HAVING FIRST AND SECOND ANNULAR SUPPORTS WITH IMMOVABLE SPACE HOLDING AND PARALLEL ELONGATED MEMBER EXTENDING THERE BETWEEN

[75] Inventor: Yoshihiko Aikawa, Shizuoka, Japan

[73] Assignee: Aikawa Iron Works Co., Ltd., Shizuoka, Japan

[21] Appl. No.: 741,718

[22] Filed: Oct. 31, 1996

[30] Foreign Application Priority Data

Jun. 20, 1996 [JP] Japan ..... 8-159551

[51] Int. Cl.[6] ..... B01D 39/10; B07B 1/46

[52] U.S. Cl. ..... 210/497.01; 210/499; 162/357; 162/384; 29/896.62; 209/273; 209/395; 209/411

[58] Field of Search ..... 162/357, 384; 210/402, 499, 497.01; 29/896.6, 896.62; 209/273, 393, 395, 407, 411

[56] References Cited

U.S. PATENT DOCUMENTS 3,747,770 7/1973 Zentis ..... 210/499
4,045,853 9/1977 White ..... 210/402
4,066,555 1/1978 Pascale ..... 210/402
4,210,539 7/1980 Shiban ..... 210/402
5,091,084 2/1992 Krettek ..... 210/232

*Primary Examiner*—W. L. Walker
*Attorney, Agent, or Firm*—Kanesaka & Takeuchi

[57] ABSTRACT

A papermaking screen of the invention is formed of first and second annular supporting members having a plurality of first and second recesses, and space holding members fixed to the first and second annular supporting members to establish a predetermined distance therebetween. In the invention, one or more elongated member groups having a plurality of elongated members are disposed between the first and second annular supporting members. The elongated members are disposed in the recesses and arranged parallel to each other to form a space between two elongated members situated adjacent to each other. Also, one or more intermediate supporting members may be situated between the first and second annular supporting members. The elongated member group may be situated between the first and second annular supporting members, between the intermediate supporting members, and between the intermediate supporting member and the first or second annular supporting member. The papermaking screen having good performance can be manufactured easily.

10 Claims, 14 Drawing Sheets

PAPERMAKING SCREEN HAVING FIRST AND SECOND ANNULAR SUPPORTS WITH IMMOVABLE SPACE HOLDING AND PARALLEL ELONGATED MEMBER EXTENDING THERE BETWEEN

BACKGROUND OF THE INVENTION AND RELATED ART STATEMENT

The present invention relates to a papermaking screen, more particularly, a papermaking screen formed by annularly arranged longitudinally extending members with a predetermined space therebetween, which can be used as a slit.

The present applicant has filed a Japanese Patent Application (Application No. 5-87616; Publication (KOKAI) No. 6-299490), wherein a papermaking screen uses as slits spaces formed by arranging longitudinally extending members in parallel.

The above papermaking screen is formed of a first annular supporting member provided at one side, a second annular supporting member provided at the other side, and longitudinally extending members, each being fixed by welding to the first annular supporting member at one end and the second annular supporting member at the other end. Further, the longitudinally extending members are disposed parallel in an annular shape to thereby form a space, as a slit, between the respective parallel members.

However, in the prior art papermaking screen, both ends of the longitudinally extending members disposed parallel are fixed by welding, respectively. Since the longitudinally extending members are thermally deformed by the welding, spaces formed by arranging the longitudinally extending members in parallel are not made equal to thereby degrade the ability of the papermaking screen. Further, the longitudinally extending members are large in number and have to be fixed by welding. Thus, there have been problems of poor performance and productivity.

A papermaking screen for solving the above problems has been filed as Japanese Patent Application No. 7-11868.

This papermaking screen is formed of a first annular supporting member at one side, a second annular supporting member at the other side, and a plurality of space holding members, each being fixed at one end to the first annular supporting member and at the other end to the second annular supporting member by welding to thereby establish a distance between the first annular supporting member and the second annular supporting member. And a plurality of longitudinally extending members arranged parallel to each other is situated between annular recesses formed in the first and second annular supporting members, each being engaged at one end with the recess provided in the first annular supporting member and at the other end with the recess provided in the second annular supporting member. Thus, the welding portions can be greatly reduced.

However, in the prior papermaking screen, since the longitudinally extending members are engaged with the annularly formed recesses, i.e. grooves, at both ends thereof, although movement of the longitudinally extending members in a diametral direction can be controlled by the grooves, movement in a circumferential direction thereof can not be controlled. Thus, when a papermaking screen is manufactured, it is difficult to hold the longitudinally extending members at predetermined positions, and a jig for holding the longitudinally extending members at the predetermined positions is required. When a shape of the longitudinally extending members is changed, a new jig is required, thus resulting in poor productivity.

The present invention has been made to provide a papermaking screen to solve the above defects, and an object of the invention is to provide a papermaking screen, which can be manufactured easily.

SUMMARY OF THE INVENTION

A papermaking screen of the invention is basically formed of a first annular supporting member having a plurality of first recesses formed at one side thereof and arranged annularly along an entire length thereof, a second annular supporting member having a plurality of second recesses formed at one side thereof and arranged annularly along an entire length thereof, a plurality of space holding members fixed to the first and second annular supporting members and laterally spaced apart from each other to establish a predetermined distance between the first and second annular supporting members, and a plurality of elongated members disposed in and held by the first and second recesses. The elongated members are arranged parallel to each other to form a space between two elongated members situated adjacent to each other as a slit for screening a paper material.

In the invention, the space holding members are firmly fixed, for example by welding, to the first and second annular supporting members, and the elongated members are simply disposed in the first and second recesses without welding. Therefore, the papermaking screen can be manufactured easily.

In the invention, at least one, i.e. one or more, intermediate supporting member may be situated between the first and second annular supporting members. In this case, the space holding members pass through the at least one intermediate supporting member and fixed to the first and second annular supporting members. Also, instead of simply using the annularly arranged elongated members, a plurality of elongated member groups is used. In each group, elongated members are annularly arranged.

The at least one intermediate supporting member has a plurality of recesses on both sides and arranged annularly along an entire length thereof. A number of the recesses formed on one side of the at least one intermediate supporting member corresponds to a number of the recesses facing thereto.

The elongated members in one elongated member group is disposed in and held by the recesses in the first annular supporting member and the at least one intermediate supporting member, and the elongated members in another elongated member group is disposed in and held by the recesses in the second annular supporting member and the at least one intermediate supporting member. The elongated members in the groups are arranged parallel to each other to form a space between two elongated members situated adjacent to each other. In case a plurality of intermediate supporting members is situated between the first and second annular supporting members, one elongated member group is also situated between the two intermediate supporting members. A desired number of intermediate supporting members and elongated member groups may be installed between the first and second annular supporting members.

Each of the space holding members includes a rod immovably fixed to the first and second annular supporting members, and one or more span holding members covering the rod. The span holding member is situated between the supporting members, e.g. between the first and second annular supporting members, between the first or second annular supporting member and the intermediate supporting member and between the intermediate supporting members.

The span holding members keep the space between the two supporting members.

DETAILED DESCRIPTION OF PREFERRED EMBODIMENTS

Figure 1:
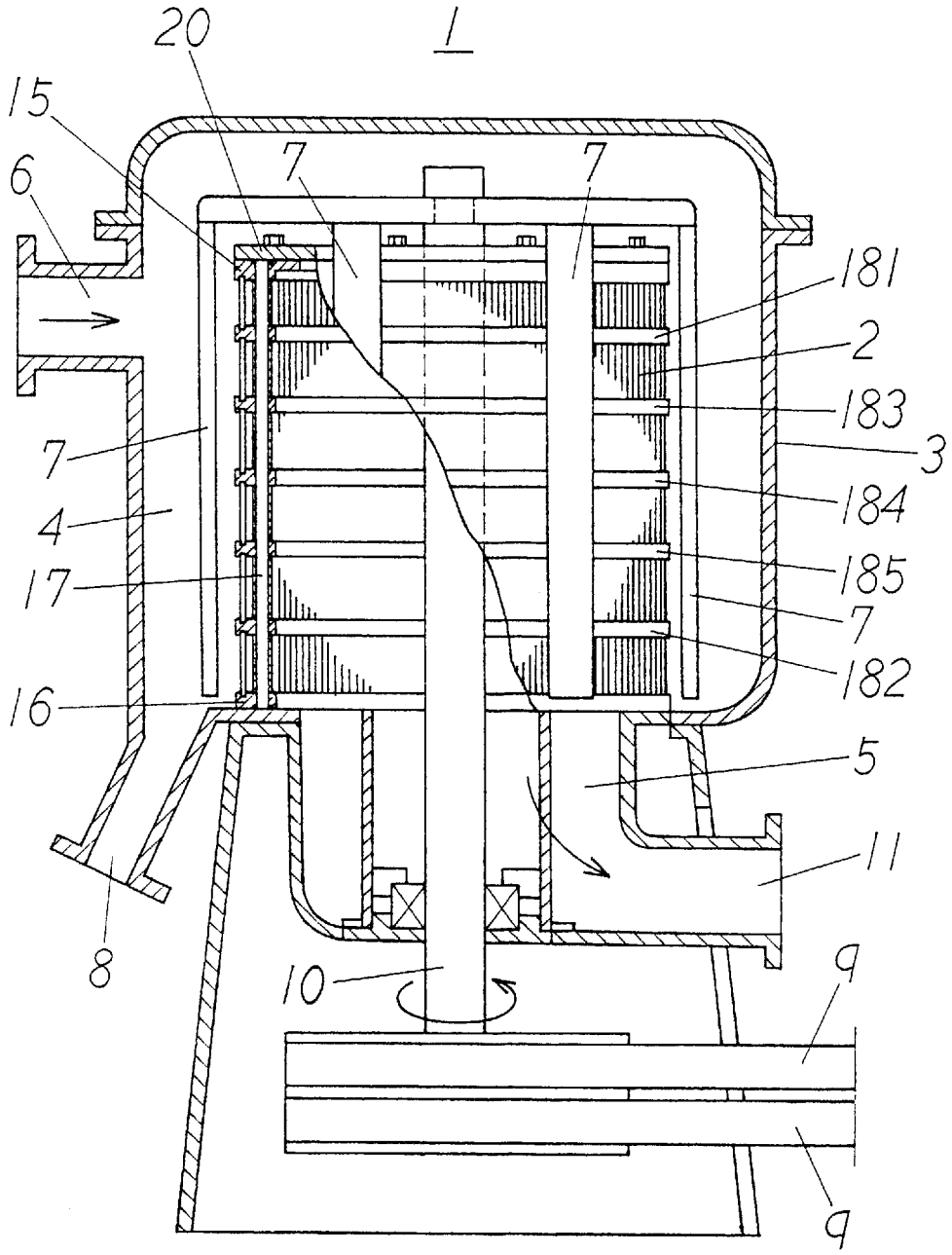
FIG. 1 is a sectional view of a papermaking screen device, into which a papermaking screen of an embodiment of the present invention is incorporated.

Papermaking screens of the embodiments of the present invention are described referring to the drawings.

In FIGS. 1 through 12, reference numeral 1 represents a papermaking screen device. The papermaking screen device 1 is, for example, a centripetal type screen as shown in FIG. 1, wherein a papermaking material flows from an outside of a papermaking screen 2 into an interior thereof to thereby clean or select the papermaking material, and a casing 3 is approximately divided into a primary chamber 4 and a secondary chamber 5 in its interior by the papermaking screen 2.

The primary chamber 4 is provided with an inlet 6 for feeding a papermaking material, such as pulp and old paper, into the casing 3, a plurality of agitating members 7 for agitating the papermaking material, and a foreign material discharging port 8 for discharging a foreign material to an outside of the casing 3. The foreign material discharging port 8 is opened and closed by, for example; a valve (not shown).

The agitating members 7 are connected to a shaft 10 and are rotated by rotation of a motor (not shown) transmitted through belts 9 and the shaft 10.

Reference numeral 11 is an exit for discharging a cleaned papermaking material outside the casing 3, and the papermaking material exit 11 is provided to the secondary chamber 5.

Figure 2:
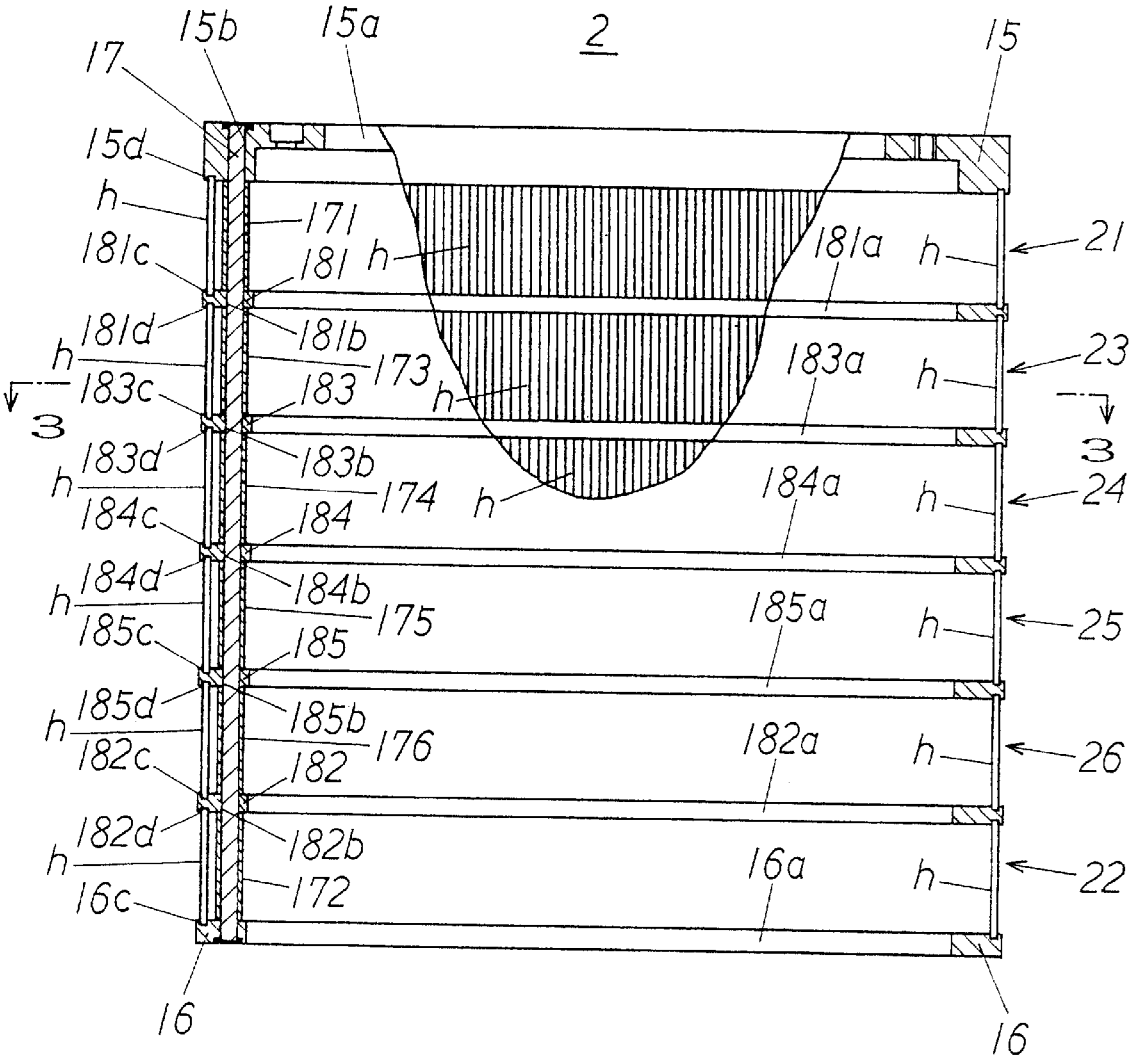
FIG. 2 is a sectional view of the papermaking screen shown in FIG. 1.

The papermaking screen 2, as shown in FIG. 2, is provided with a first annular supporting member 15 at one end, and a second annular supporting member 16 at the other end thereof, respectively.

Figure 6:
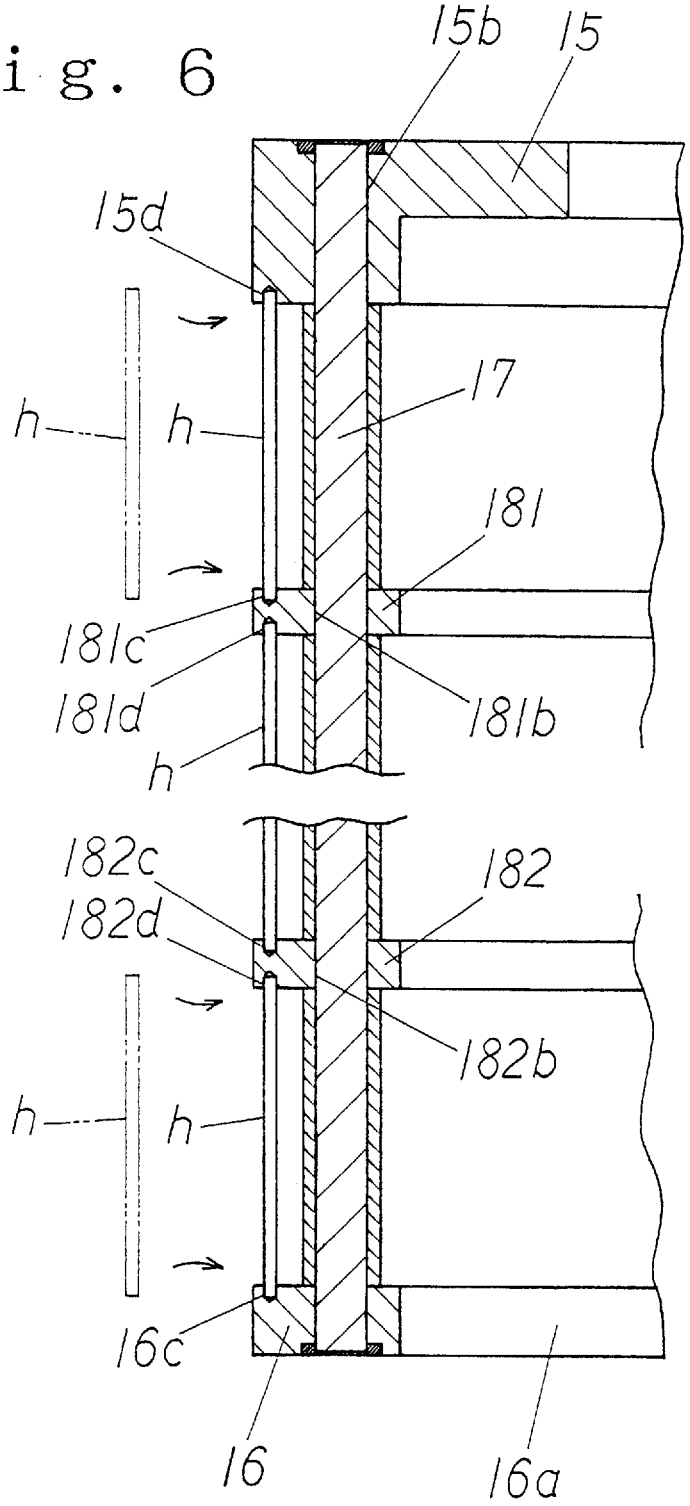
FIG. 6 is a partially enlarged sectional view of a portion of FIG. 2.
Figure 7:
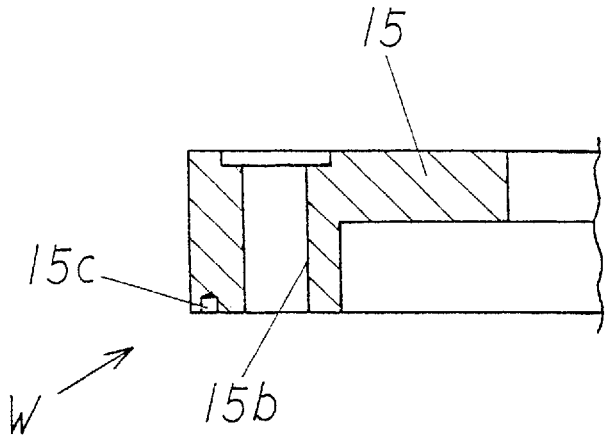
FIG. 7 is a partial sectional view of a first supporting member.
Figure 8:
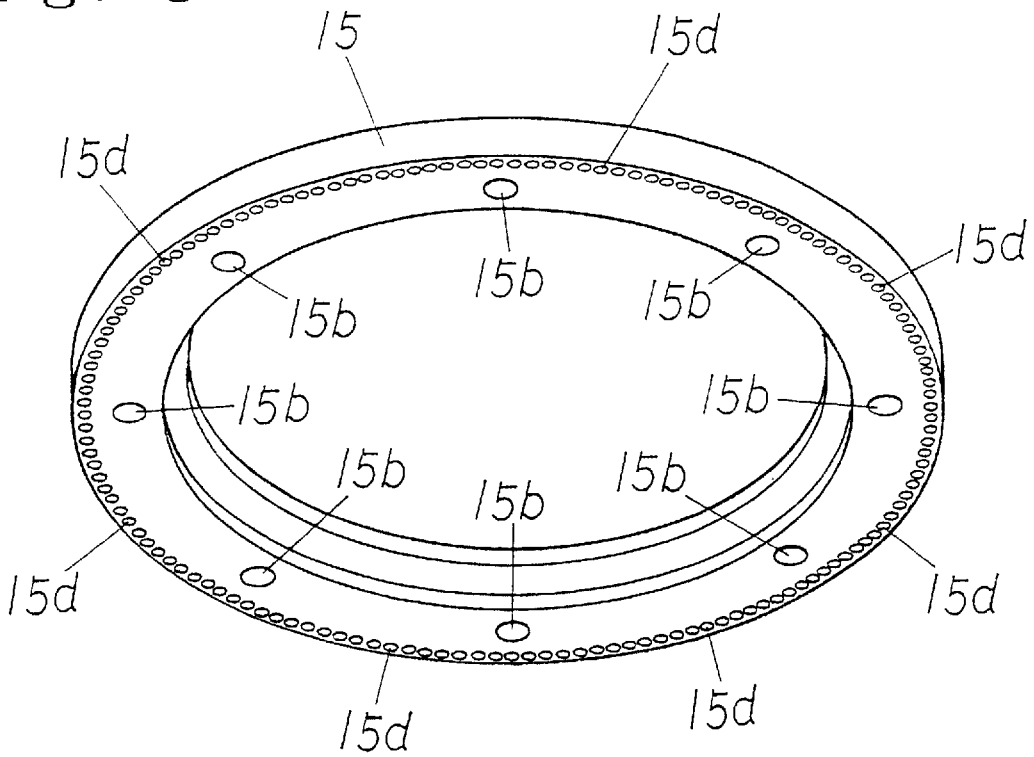
FIG. 8 is a perspective view of the first supporting member viewed from a direction of an arrow W shown in FIG. 7.
Figure 9:
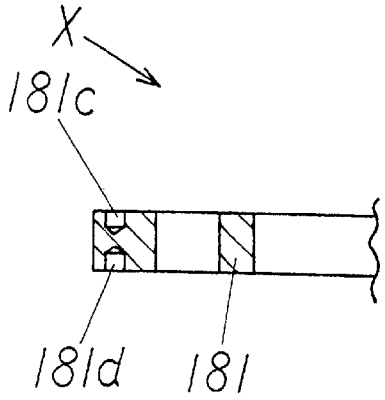
FIG. 9 is a sectional view of an intermediate supporting member.
Figure 10:
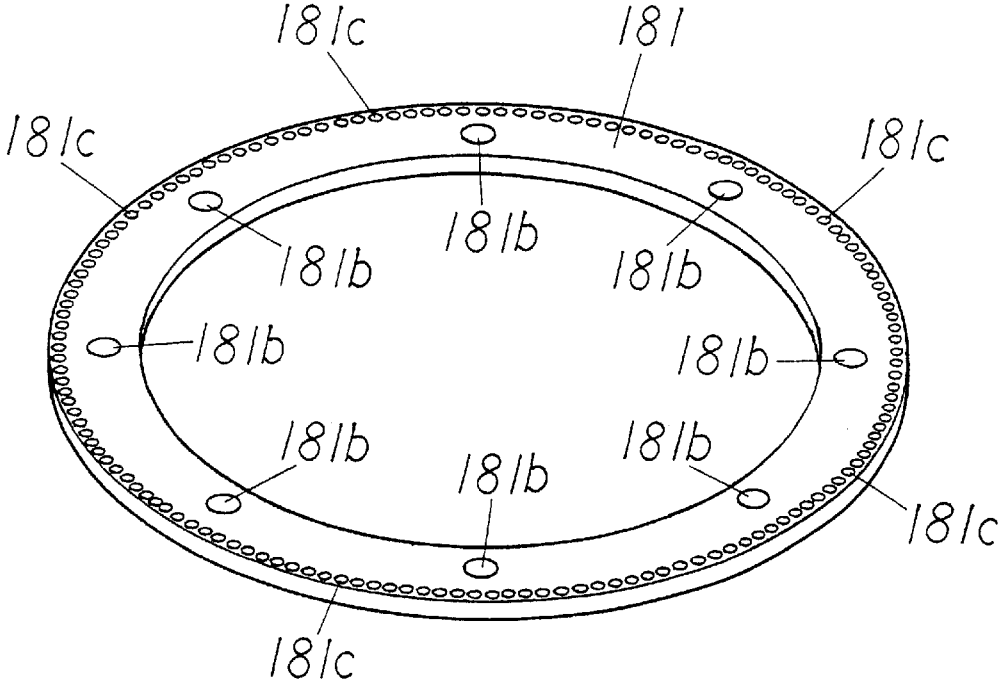
FIG. 10 is a perspective view of the intermediate supporting member viewed from an arrow X direction in FIG. 9.

The first supporting member 15 is provided with an opening 15*a*, which is closed by a ceiling plate 20 as shown in FIG. 1. Incidentally, the first supporting member 15 may not be provided with the opening 15*a* and the ceiling plate 20 may be omitted (not shown). Also, the first supporting member 15 is provided with insertion holes 15*b* for inserting space holding members 17, which will be described later, as shown in FIGS. 6 to 8.

Also, the first supporting member 15 is provided with a plurality of recesses 15*d* arranged in an annular shape with a predetermined, for example equal, space therebetween, and an intermediate supporting member 181, which will be described later, situated adjacent to the first supporting member 15 is provided with a plurality of recesses 181*c* arranged in an annular shape with a predetermined, for example equal, space therebetween, as shown in FIGS. 6 to 10. The recesses 15*d* and 181*c* are provided on the sides, facing each other, of the first supporting member 15 and the intermediate supporting member 181, respectively.

Figure 11:
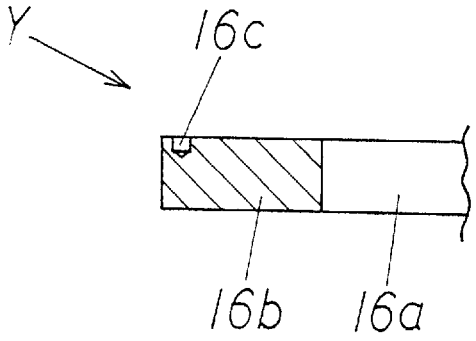
FIG. 11 is a sectional view of a second supporting member.
Figure 12:
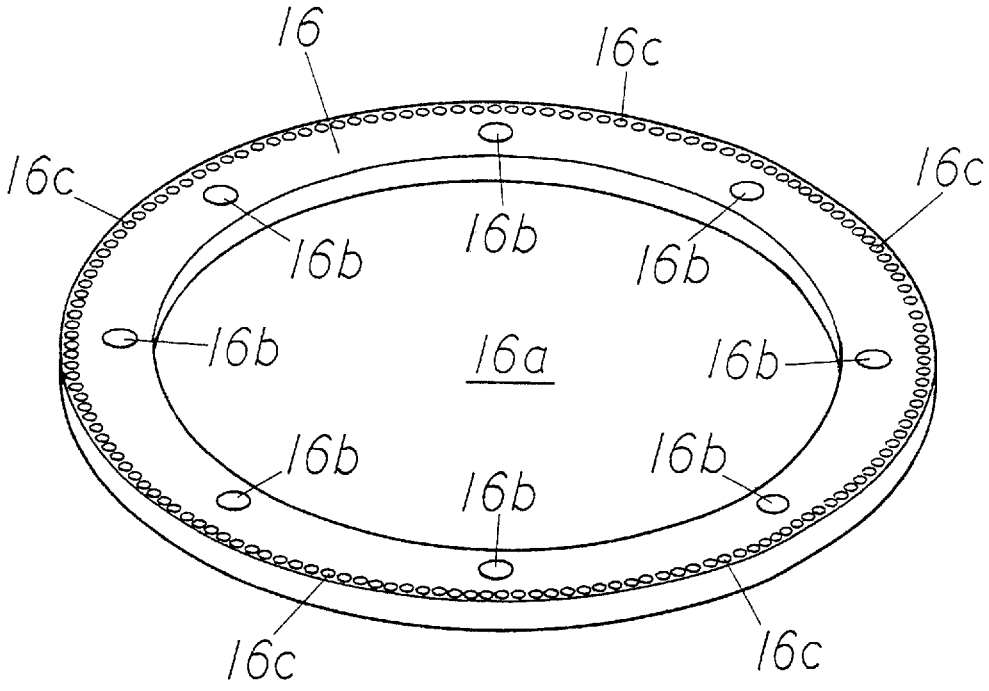
FIG. 12 is a perspective view of the second supporting member viewed from a direction of an arrow Y shown in FIG. 11.

Also, the second supporting member 16 is provided with an opening 16*a* for passing the cleaned or selected papermaking material therethrough. The second supporting member 16 is provided with a plurality of recesses 16*c* disposed in an annular shape with a predetermined, for example equal, space therebetween as shown in FIGS. 6, 11 and 12. An intermediate supporting member 182, which will be described later, situated adjacent to the second supporting member 16 is provided with a plurality of recesses 182*d* disposed in an annular shape with a predetermined, for example equal, space therebetween. The recesses 16*c* and 182*d* are provided on the sides, facing each other, of the second supporting member 16 and the intermediate supporting member 182, respectively.

Figure 3:
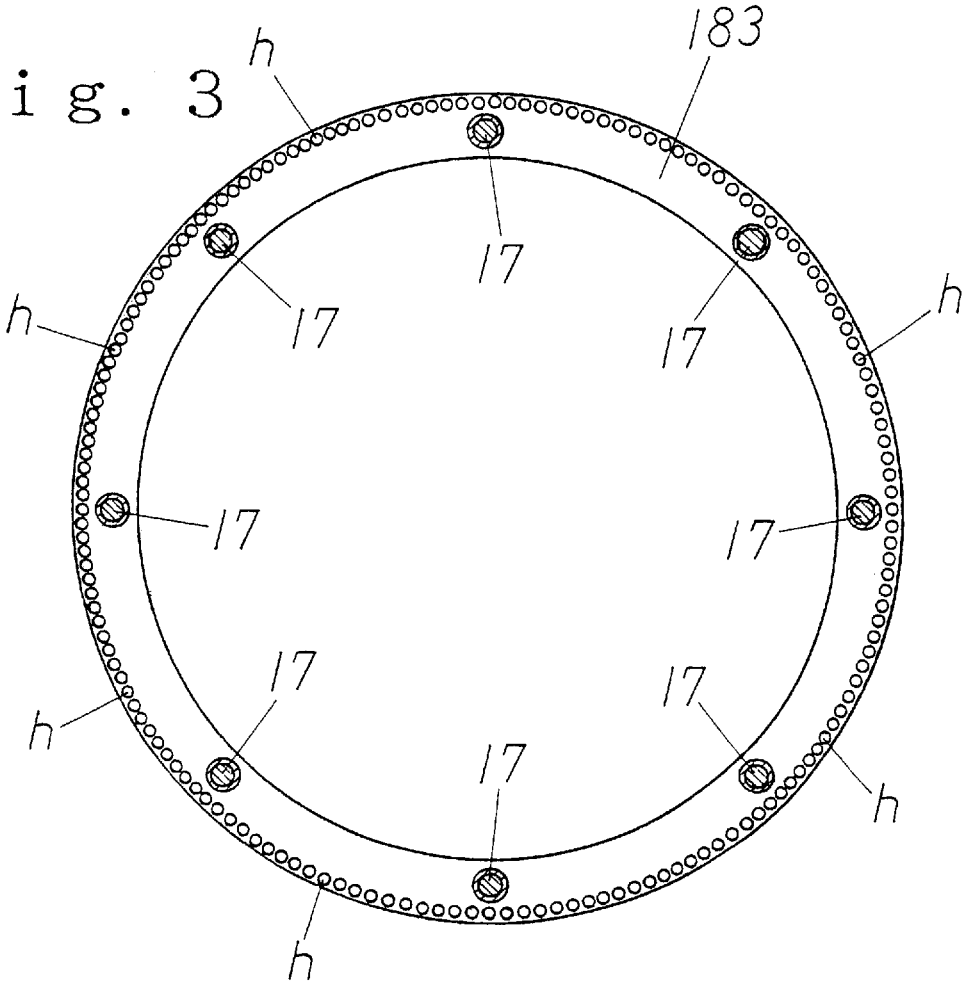
FIG. 3 is a sectional view taken along line 3—3 in FIG. 2.
Figure 4:
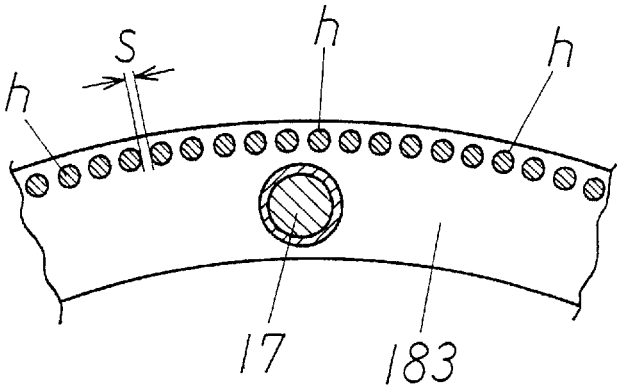
FIG. 4 is a partially enlarged sectional view of a part of FIG. 3.

Reference numeral 17 represents a plurality of space holding members, for example eight, as shown in FIG. 3. Each space holding member 17 is fixed by, for example, welding to the first supporting member 15 at one end and to the second supporting member 16 at the other end to thereby hold or form a space between the first supporting member 15 and the second supporting member 16, as shown in FIGS. 2 and 6.

The space holding members 17 are made of, for example, stainless steel, iron, resin or the like. Preferably, in order to properly keep spaces adjacent to each other, as shown in FIG. 2, span holding members, more specifically, pipes 171, 172, 173, 174, 175 may be provided on an outer periphery of the space holding member 17, in addition to the space holding members 17. Incidentally, under certain circumstances, the span holding members 171, 172, 173, 174, 175 may be omitted.

Figure 5:
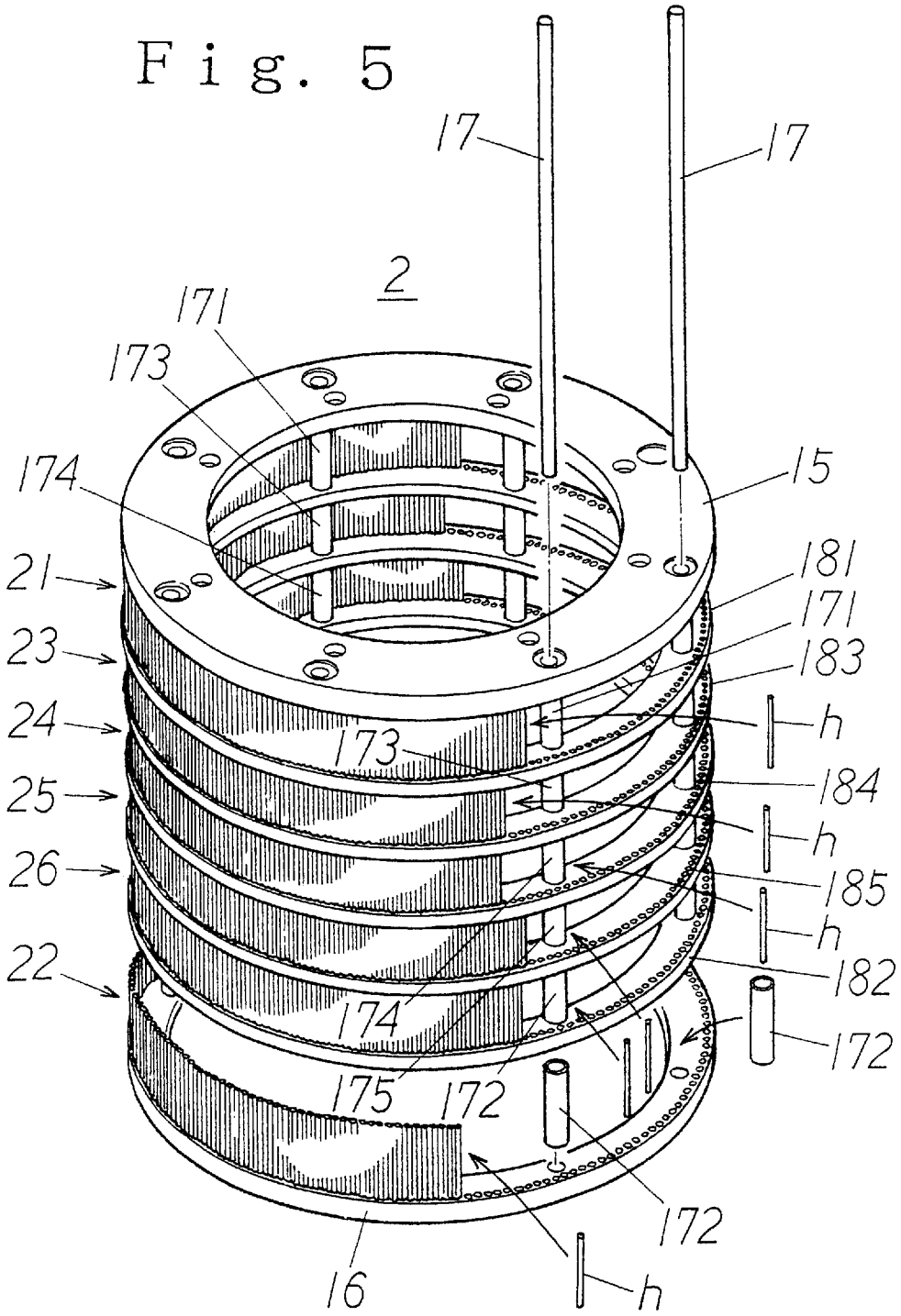
FIG. 5 is a perspective view for explaining a process for manufacturing the papermaking screen shown in FIG. 1 by incorporating longitudinally extending members.

Further, between the first supporting member 15 and the second supporting member 16, n ($n \geqq 2$, 5 in the present embodiment) pieces of intermediate supporting members 181, 183, 184, 185, 182 are disposed in this order from a side of the first supporting member 15 with an equal space therebetween, as shown in FIGS. 2 and 5.

Then, the intermediate supporting members 181, 183, 184, 185, 182, i.e. n (n≧2, 5 in the present embodiment) pieces, are respectively provided with a plurality of recesses arranged in an annular shape with an equal space therebetween on both sides thereof.

More specifically, the intermediate supporting members 181, 183, 184, 185, 182 have insertion holes 181*b*, 183*b*, 184*b*, 185*b*, 182*b*, through which the space holding members 17 pass, respectively, and are provided with the plural recesses 181*c*, 181*d*; 183*c*, 183*d*; 184*c*, 184*d*; 185*c*, 185*d*; 182*c*, 182*d* on both sides thereof outside the insertion holes 181*b*, 183*b*, 184*b*, 185*b*, 182*b*, respectively, with a predetermined space. Namely, as shown in FIGS. 2 and 6, the intermediate supporting member 181 has the recesses 181*c* on one side and the recesses 181*d* on the other side thereof; the intermediate supporting member 183 has the recesses 183*c* on one side and the recesses 183*d* on the other side thereof; the intermediate supporting member 184 has the recesses 184*c* on one side and the recesses 184*d* on the other side thereof; the intermediate supporting member 185 has the recesses 185*c* on one side and the recesses 185*d* on the other side thereof; and the intermediate supporting member 182 has the recesses 182*c* on one side and the recesses 182*d* on the other side thereof, respectively.

Also, the intermediate supporting members 181, 183, 184, 185, 182 are provided with central openings 181*a*, 183*a*, 184*a*, 185*a*, 182*a*, respectively.

Reference numeral 21 represents a first longitudinally extending member group. The first longitudinally extending member group 21 comprises longitudinally extending members h, each of which has, for example, a circular cross section with a diameter of about 2.5 mm to about 6.0 mm, and a length of about 100 mm to about 200 mm. Each of the longitudinally extending members h is engaged at one end with each of the recesses 15*d* annularly provided in the first supporting member 15 and at the other end with each of the recesses 181*c* annularly provided in the intermediate supporting member 181 adjacent to the first supporting member 15. Namely, engagement of each longitudinally extending member h with the recess 15*d* at one end and with the recess 181*c* at the other end is made by inserting one end of the longitudinally extending member h into the recess 15*d* and the other end thereof into the recess 181*c*. The longitudinally extending members h are disposed in the recesses 181*c* parallel to each other along an annular shape with, for example, 200 pieces to 1,500 pieces, as shown in FIGS. 2 and 5.

The plural recesses 15*d* annularly disposed in the first supporting member 15 and the plural recesses 181*c* annularly disposed in the intermediate supporting member 181 adjacent to the first supporting member 15 are provided on the sides, facing each other, of the first supporting member 15 and the intermediate supporting member 181.

The first longitudinally extending member group 21 comprises a plurality of longitudinally extending members h disposed parallel to each other in an annular shape, and a space S is formed between the longitudinally extending members h adjacent to each other. The space S functions as a mesh of the screen.

Also, a second longitudinally extending member group 22 is situated between the second supporting member 16 and the intermediate supporting member 182 adjacent thereto, as shown in FIGS. 2, 5 and 6.

The second longitudinally extending member group 22 comprises a plurality of longitudinally extending members h, wherein each of the longitudinally extending members h is engaged at one end with each of the recesses 16*c* annularly provided in the second supporting member 16 with a predetermined, for example equal, space apart from each other and at the other end with each of the recesses 182*d* annularly provided in the intermediate supporting member 182 adjacent to the second supporting member 16 with a predetermined, for example equal, space apart from each other. As a result, the longitudinally extending members h are disposed parallel in an annular shape.

The second longitudinally extending member group 22 is the same as the first longitudinally extending member group 21 except for the positions where the longitudinally extending member groups are engaged. Namely, in the first longitudinally extending member group 21, each of the longitudinally extending members h is engaged with each of the recesses 15*d* at one end and with each of the recesses 181*c* at the other end, while in the second longitudinally extending member group 22, each of the longitudinally extending members h is engaged with each of the recesses 16*c* at one end and each of the recesses 182*d* at the other end.

More specifically, the plural recesses 16*c* annularly provided in the second support member 16 with a predetermined space therebetween and the plural recesses 182*d* annularly provided in the intermediate supporting member 182 with a predetermined space therebetween are provided on the sides, facing each other, of the second supporting member 16 and the intermediate supporting member 182, respectively.

The second longitudinally extending member group 22 comprises the longitudinally extending members h disposed parallel to each other in an annular shape, and a space S is formed between the longitudinally extending members h situated adjacent to each other. The space S functions as a mesh of the screen.

Also, n (n≧2) pieces of intermediate supporting members, i.e., five intermediate supporting members 181, 183, 184, 185, 182 in the present embodiment, are provided and, as shown in FIG. 2, annular recesses 181*c*, 181*d*; 183*c*, 183*d*; 184*c*, 184*d*; 185*c*, 185*d*; 182*c*, 182*d* are provided on both sides of the respective intermediate supporting members 181, 183, 184, 185, 182.

Each of the n (n≧2) pieces of the intermediate supporting members has a plurality of recesses annularly arranged with a predetermined, for example an equal, space on the sides facing the respective intermediate supporting members. More specifically, the plural recesses 181*d* and the plural recesses 183*c* are provided on the facing sides of the intermediate supporting members 181 and 183; the plural recesses 183*d* and the plural recesses 184*c* are provided on the facing sides of the intermediate supporting members 183 and 184; the plural recesses 184*d* and the plural recesses 185*c* are provided on the facing sides of the intermediate supporting members 184 and 185; and the plural recesses 185*d* and the plural recesses 182*c* are provided on the facing sides of the intermediate supporting members 185 and 182, respectively.

And, one longitudinally extending member group is disposed between two intermediate supporting members, that is, the intermediate supporting members facing each other. In case of n (n≧2) pieces of intermediate supporting members, (n−1) longitudinally extending member groups, four longitudinally extending member groups in the present embodiment, are provided.

Each of the longitudinally extending member group 23, 24, 25, 26 comprises, as shown in FIG. 2, longitudinally extending members h. Each of the longitudinally extending members h is engaged at one end with each of the recesses 181*d*, 183*d*, 184*d*, 185*d* annularly disposed on the intermediate supporting members 181, 183, 184, 185 with a predetermined space therebetween and at the other end with each of the recesses 183*c*, 184*c*, 185*c*, 182*c* annularly provided on the intermediate supporting members 183, 184, 185, 182 adjacent to the intermediate supporting member 181, 183, 184, 185. The longitudinally extending members h are arranged parallel to each other along an annular shape in the recesses 183*c*, 184*c*, 185*c*, 182*c* and the recesses 181*d*, 183*d*, 184*d*, 185*d* with, for example, 200 to 1,500 pieces of the longitudinally extending members h, as shown in FIGS. 2 and 5.

Also, the papermaking screen 2 is provided with a plurality of the space holding members 17. Each of the space holding members 17 passes through the insertion holes 181*b*, 183*b*, 184*b*, 185*b*, 182*b* of the intermediate supporting members 181, 183, 184, 185, 182, and is fixed to the first supporting member 15 at one end and the second supporting member 16 at the other end by, for example, welding to thereby establish a space between the first supporting member 15 and the second supporting member 16.

Incidentally, the first longitudinally extending member group 21, the (n−1) longitudinally extending member groups, e.g. four groups 23, 24, 25, 26 in the present embodiment, and the second longitudinally extending member group 22 are arranged in this order from the first supporting member 15 to the second supporting member 16.

Also, the n (n≧2) intermediate supporting members, e.g. five intermediate supporting members 181, 183, 184, 185, 182 in the present embodiment, are supported by the respective longitudinally extending member groups situated adjacent to each other out of the first longitudinally extending member group 21, the (n−1) longitudinally extending member groups, e.g. four longitudinally extending member groups 23, 24, 25, 26 in the present embodiment and the second longitudinally extending member group 22. Namely, in the present embodiment, the intermediate supporting member 181 is supported by the first longitudinally extending member group 21 and the longitudinally extending member group 23; the intermediate supporting member 183 is held by the longitudinally extending member groups 23 and 24; the intermediate supporting member 184 is held by the longitudinally extending member groups 24 and 25; the intermediate supporting member 185 is held by the longitudinally extending member groups 25 and 26; and the intermediate supporting member 182 is held by the longitudinally extending member group 26 and the second longitudinally extending member group 22.

In the longitudinally extending members h, a space S formed between the longitudinally extending members h situated adjacent to each other functions as a slit.

Figure 13:
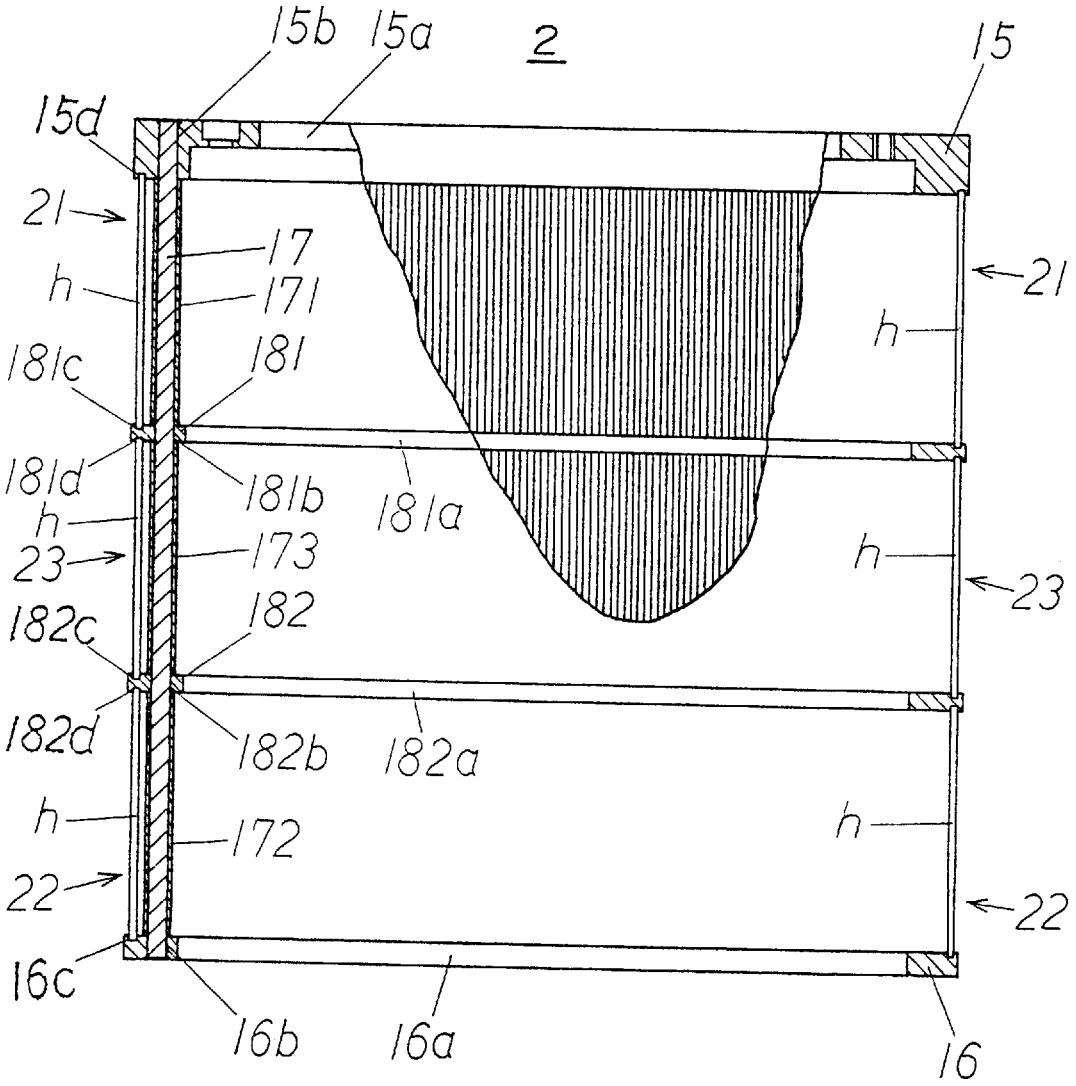
FIG. 13 is a sectional view of a papermaking screen of a second embodiment.

In the above embodiment, as an example for n (n≧2) pieces of the intermediate supporting members, the five intermediate supporting members have been explained. However, the invention can be applied to an example with two intermediate supporting members as shown in FIG. 13 in the same manner by omitting the intermediate supporting members 183, 184, 185 and the longitudinally extending member groups 24, 25, 26 from the above embodiment as shown in FIG. 2.

Figure 14:
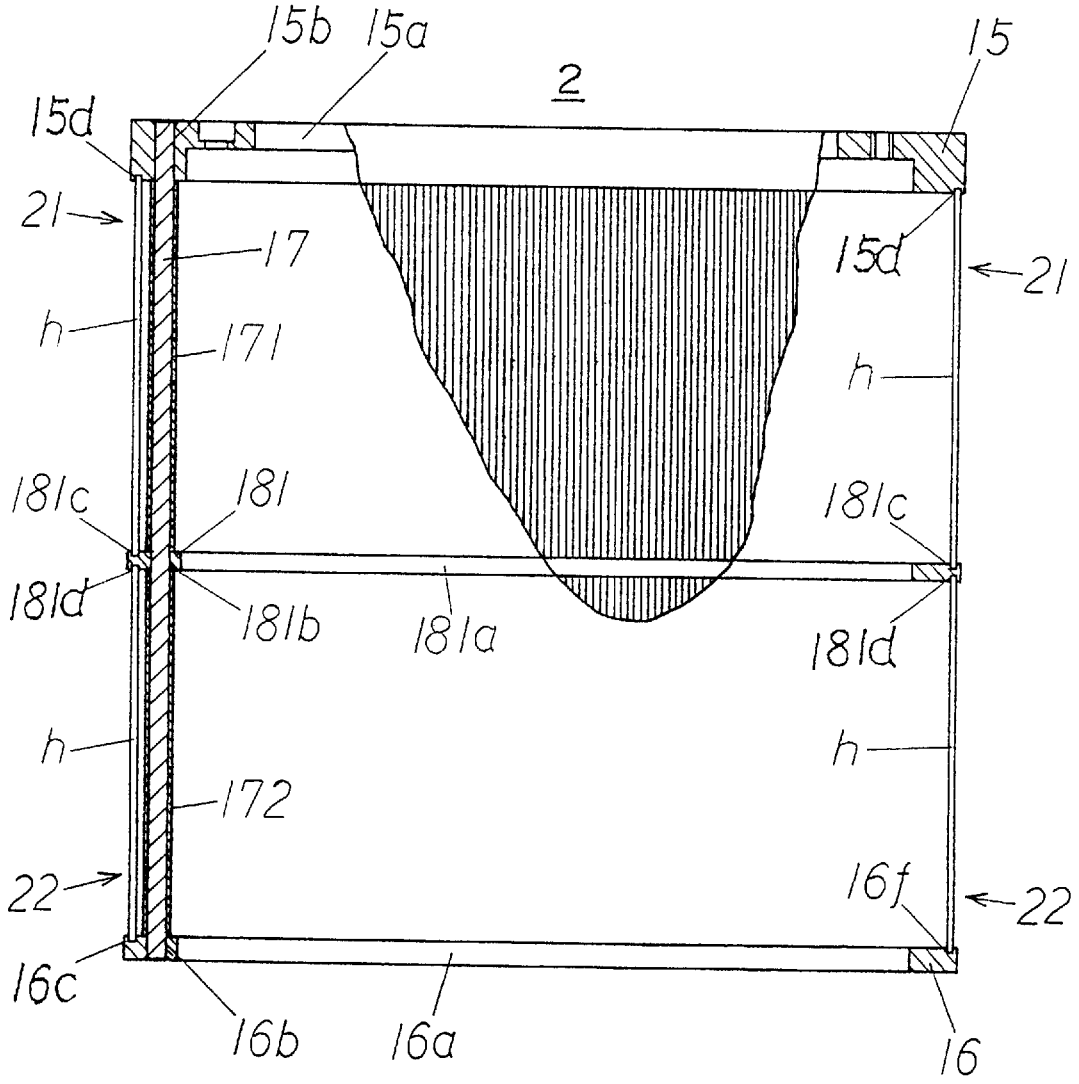
FIG. 14 is a sectional view of a papermaking screen of a third embodiment.

Also, the invention can be applied to an example with one intermediate supporting member as shown in FIG. 14 in the same manner by omitting the intermediate supporting members 183, 184, 185, 182 and the longitudinally extending member groups 23, 24, 25, 26 from the papermaking screen 2 as shown in FIGS. 1 to 12.

More specifically, the papermaking screen 2 is provided with a plurality of space holding members 17, each being fixed by, for example, welding to a first annular supporting member 15 at one end and a second annular supporting member 16 at the other end to thereby establish a space between the first and second supporting members 15, 16.

Then, an intermediate supporting member 181 is situated between the first and second supporting members 15, 16, and is provided with insertion holes 181*b*, through which the space holding members 17 pass. Also, the intermediate supporting member 181 is provided with a central opening 181*a*.

A first longitudinally extending member group 21 is located between the first supporting member 15 and the intermediate supporting member 181.

The first longitudinally extending member group 21 comprises a plurality of longitudinally extending members h. Each of the longitudinally extending members h is engaged at one end with each of recesses 15*d* annularly arranged in the first supporting member 15 with a predetermined, for example equal, space therebetween and at the other end with each of recesses 181*c* annularly arranged in the intermediate supporting member 181 with a predetermined, for example equal, space therebetween. The longitudinally extending members h are disposed parallel to each other in the recesses 15*d* and 181*c* in an annular shape with, for example, 200 pieces to 1,500 pieces as shown in FIG. 14.

The recesses 15*d* disposed in the first supporting member 15 and the recesses 181*c* disposed in the intermediate supporting member 181 are provided on the sides, facing each other, of the first supporting member 15 and the intermediate supporting member 181, respectively.

The first longitudinally extending member group 21 comprises the longitudinally extending members h disposed parallel to each other in an annular shape, and a space S formed between the longitudinally extending members h situated adjacent to each other functions as a slit.

Also, between the second supporting member 16 and the intermediate supporting member 181, a second longitudinally extending member group 22 is located.

The second longitudinally extending member group 22 comprises a plurality of longitudinally extending members h. Each of the longitudinally extending members is engaged at one end with each of recesses 16*c* annularly arranged in the second supporting member 16 with a predetermined, i.e. equal, space therebetween and at the other end with each of recesses 181*d* annularly arranged in the intermediate supporting member 181 with a predetermined, i.e. equal, space therebetween. The longitudinally extending members h are disposed parallel to each other in the recesses 16*c* and 181*d* in an annular shape with, for example, 200 pieces to 1,500 pieces as shown in FIG. 14.

The second longitudinally extending member group 22 is the same as the first longitudinally extending member group 21 except for the positions with which the longitudinally extending member groups are engaged. Namely, in the first longitudinally extending member group 21, each of the longitudinally extending members h is engaged with each of the recesses 15*d* at one end and each of the recesses 181*c* at the other end, while in the second longitudinally extending member group 22, each of the longitudinally extending members h is engaged with each of the recesses 16*c* at one end and each of the recesses 181*d* at the other end.

In other words, the recesses 16*c* disposed in the second supporting member 16 and the recesses 181*d* disposed in the intermediate supporting member 181 are provided on the sides, facing each other, of the second supporting member 16 and the intermediate supporting member 181, respectively.

The second longitudinally extending member group 22 comprises the longitudinally extending members h disposed parallel to each other in an annular shape. A space formed between the longitudinally extending members h situated adjacent to each other functions as a slit.

The papermaking screen 2 is provided with a plurality of space holding members 17 passing through insertion holes 181*b* of the intermediate supporting member 181. Each space holding member 17 is fixed at one end to the first supporting member 15 and at the other end to the second supporting member 16 to thereby establish a distance between the first supporting member 15 and the second supporting member 16.

The intermediate supporting member 181 is supported by the first longitudinally extending member group 21 and the second longitudinally extending member group 22. A space is formed between the longitudinally extending members h situated adjacent to each other.

Figure 15:
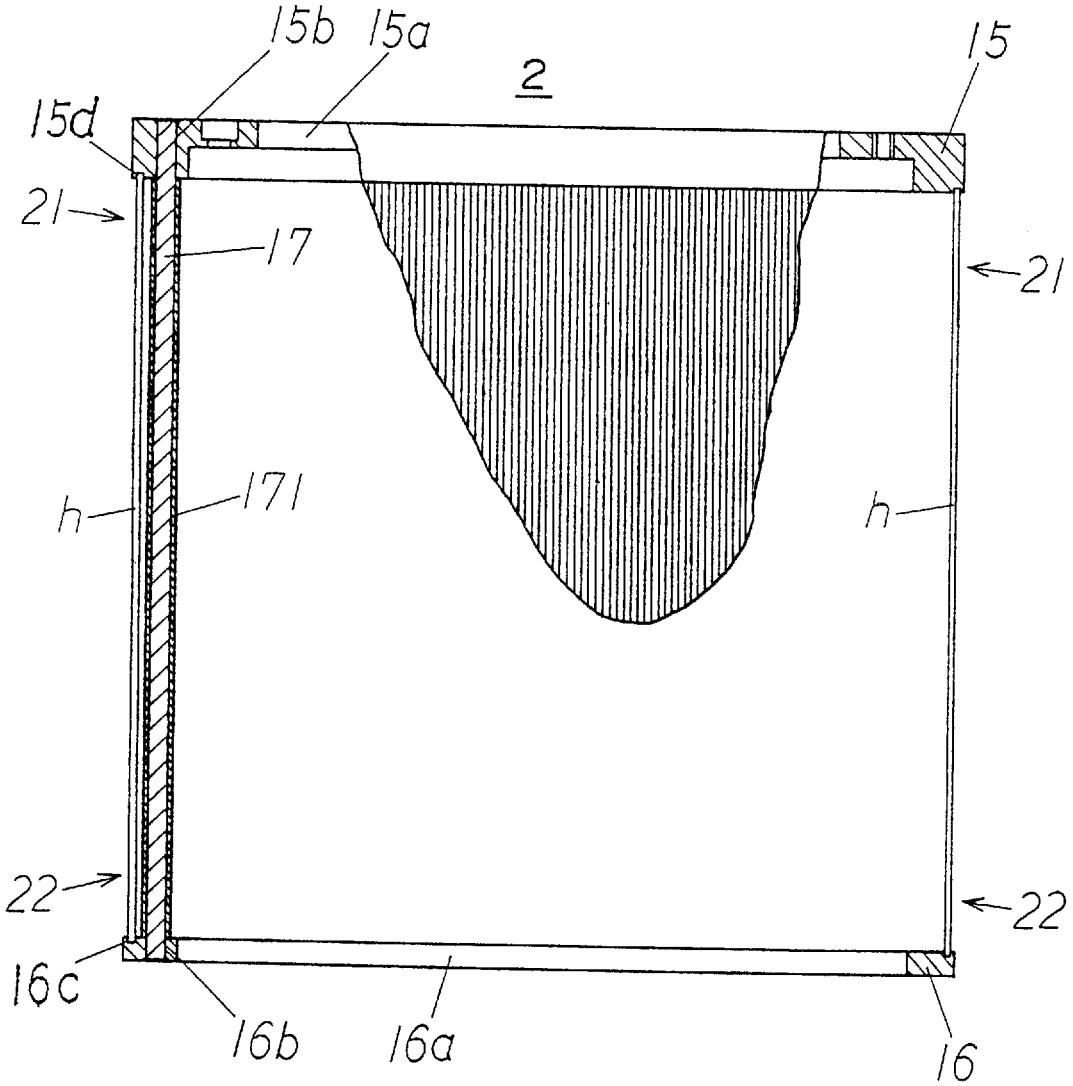
FIG. 15 is a sectional view of a papermaking screen of a fourth embodiment.

Also, the invention can be applied to a papermaking screen 2 with no intermediate supporting member, as shown in FIG. 15, in the same manner by omitting the intermediate supporting members 181, 183, 184, 185, 182 and the longitudinally extending member groups 23, 24, 25, 26, 22 from the papermaking screen 2 as shown in FIGS. 1 to 12.

More specifically, the papermaking screen 2 is provided with a plurality of space holding members 17. Each of the space holding members 17 is fixed to a first supporting member 15 at one end and a second supporting member 16 at the other end to thereby establish a distance between the first supporting member 15 and the second supporting member 16.

And, between the first supporting member 15 and the second supporting member 16, a first longitudinally extending member group 21 is disposed.

The first longitudinally extending member group 21 comprises a plurality of longitudinally extending members h. Each of the longitudinally extending members is engaged at one end with, for example inserted into, each of recesses 15*d* annularly arranged in the first supporting member 15 with a predetermined, i.e. equal, space therebetween and at the other end with each of recesses 16*c* annularly arranged in the second supporting member 16 with a predetermined, i.e. equal, space therebetween. The longitudinally extending members h are disposed parallel to each other in the recesses 15*d* and 16*c* in an annular shape with, for example, 200 pieces to 1,500 pieces as shown in FIG. 15.

The papermaking screen 2 is provided with a plurality of space holding members 17. Each of the space holding members 17 is fixed to the first annular supporting member 15 at one end and the second annular supporting member 16 at the other end to thereby establish a distance between the first and second supporting members 15, 16.

A space is formed between the longitudinally extending members h situated adjacent to each other.

Figure 16:
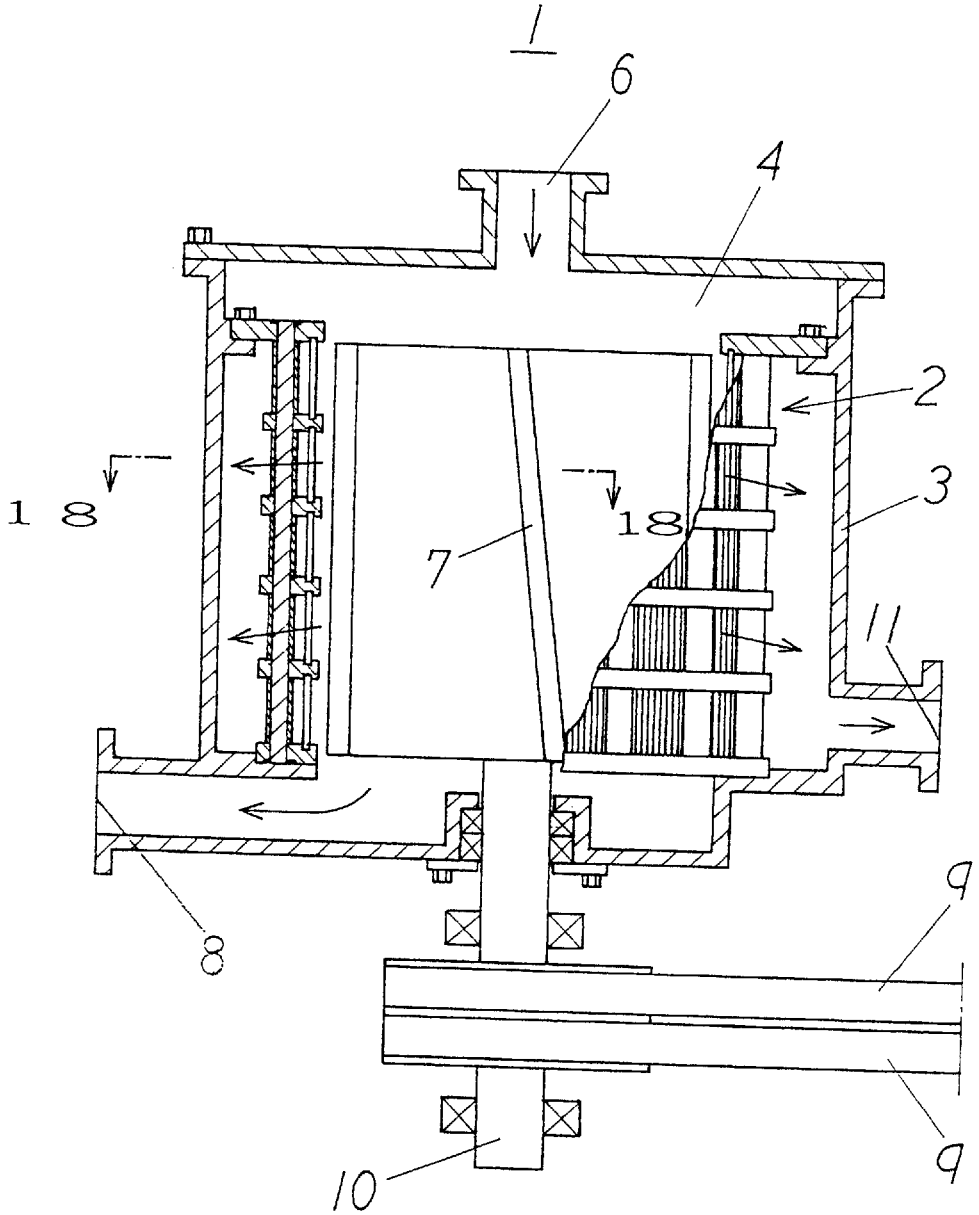
FIG. 16 is a sectional view of a papermaking screen device, into which a papermaking screen of an embodiment of the invention is incorporated.
Figure 17:
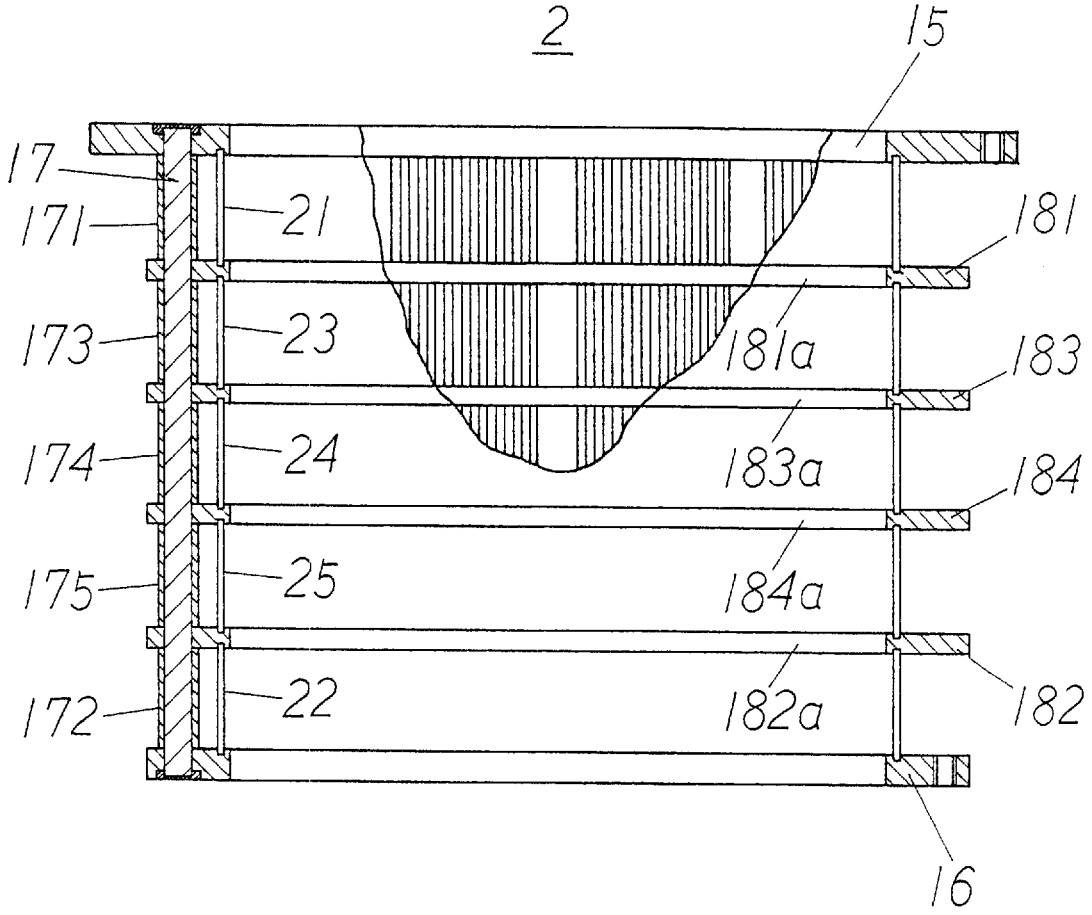
FIG. 17 is a sectional view of the papermaking screen shown in FIG. 16.
Figure 18:
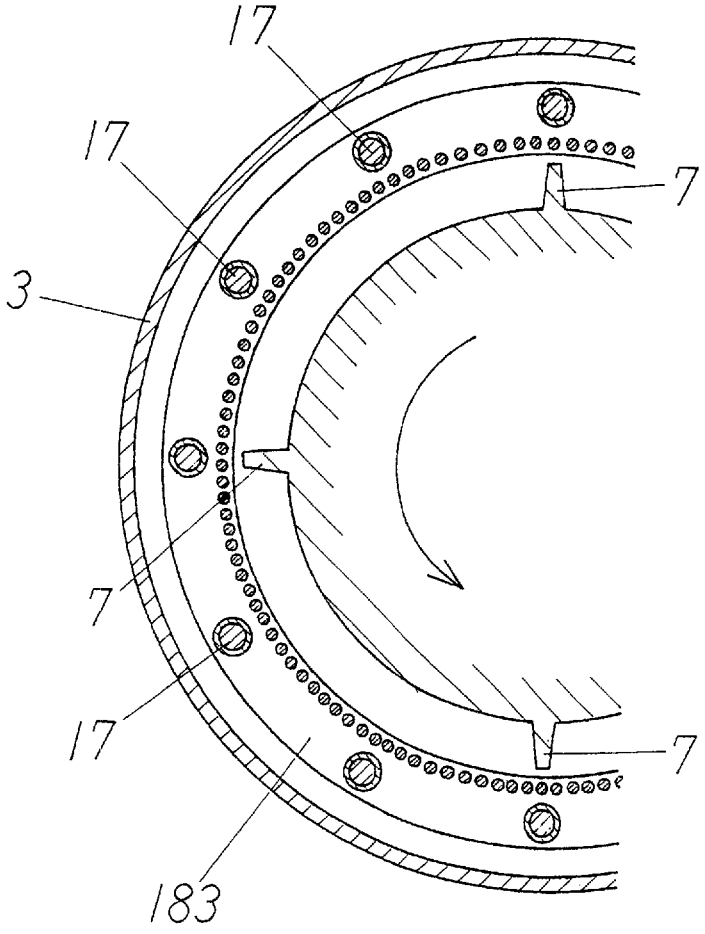
FIG. 18 is a sectional view taken along line 18—18 in FIG. 16.

Incidentally, in the above described embodiments, explanation has been made for the examples where the papermaking screen 2 is applied to, for example, a centripetal-type screen device, wherein a papermaking material flows from an outside of a papermaking screen 2 into an interior thereof to thereby clean or select the papermaking material. However, the papermaking screen 2 of the present invention can also be applied to a centrifugal-type screen device, wherein the papermaking material flows from the interior of the papermaking screen 2 to the outside thereof as shown in FIG. 16. In this case, however, since it is effective that an agitating member, i.e. agitator, is located near the longitudinally extending members h, i.e. screen bars, the space holding members 17 are preferably positioned outside the longitudinally extending members h.

In a first aspect of a papermaking screen of the present invention, a first longitudinally extending member group, (n−1) longitudinally extending member groups and a second longitudinally extending member group are positioned in this order from a first supporting member to a second supporting member, and each intermediate supporting member is supported by the longitudinally extending member groups situated adjacent to each other out of the first longitudinally extending member group, the (n−1) longitudinally extending member groups and the second longitudinally extending member group, without fixing by welding as in a conventional art. Thus, a papermaking screen with good performance can be obtained.

Also, each of the longitudinally extending members in one group is engaged at one end with each of the recesses annularly provided in the first supporting member with a predetermined space therebetween, and at the other end with each of the recesses annularly provided in the intermediate supporting member adjacent thereto with a predetermined space therebetween. Further, each of the longitudinally extending members in another group is engaged at one end with each of the recesses annularly provided in the second supporting member with a predetermined space therebetween, and at the other end with each of the recesses annularly provided in the intermediate supporting member adjacent thereto with a predetermined space therebetween. Also, each of the longitudinally extending members in the other group is engaged at one end with each of the recesses annularly provided in the respective intermediate supporting members with a predetermined space therebetween, and at the other end with each of the recesses annularly provided in the intermediate supporting members adjacent thereto with a predetermined space therebetween.

Therefore, movements of the longitudinally extending members in a diametral direction as well as in a circumferential direction can be controlled without using a jig. Thus, a number of the longitudinally extending members can be supported and positioned, and spaces formed by arranging the longitudinally extending members in parallel are made equal. Thus, a papermaking screen having good productivity and performance can be obtained.

Also, in a second aspect of the papermaking screen of the present invention, a first longitudinally extending member group and a second longitudinally extending member group are positioned in this order from a first supporting member to a second supporting member, and an intermediate supporting member is supported by the first longitudinally extending member group and the second longitudinally extending member group, without fixing a number of longitudinally extending members by welding as in a conventional art. Thus, a papermaking screen having good performance can be obtained.

Further, each of the longitudinally extending members in the first group is engaged at one end with each of the recesses annularly provided in the first supporting member with a predetermined space therebetween, and at the other end with each of the recesses annularly provided in one side of the intermediate supporting member with a predetermined space therebetween. Also, each of the longitudinally extending members in the second group is engaged at one end with each of the recesses annularly provided in the second supporting member with a predetermined space therebetween, and at the other end with each of the recesses annularly provided in the other side of the intermediate supporting member with a predetermined space therebetween.

Therefore, movements of the longitudinally extending members in a diametral direction as well as in a circumferential direction can be controlled without using a jig, so that a number of the longitudinally extending members can be supported and positioned, and spaces formed by arranging the longitudinally extending members in parallel can be made equal. Thus, a papermaking screen having good productivity and performance can be obtained.

Also, in a third aspect of the papermaking screen of the present invention, a distance between a first supporting member and a second supporting member is held by a plurality of space holding members without welding a number of longitudinally extending members as in a conventional art. Each of the longitudinally extending members is engaged at one end with each of the recesses annularly provided, with a predetermined space therebetween, in the first supporting member, and at the other end with each of the recesses annularly provided, with a predetermined space therebetween, in the second supporting member. Therefore, a papermaking screen having good performance can be obtained. Further, without using a jig, movements of the longitudinally extending members in a diametral direction as well as in a circumferential direction can be controlled, and a number of the longitudinally extending members can be supported and positioned. Also, spaces formed by arranging the longitudinally extending members in parallel can be made equal. Thus, a papermaking screen having good productivity and performance can be obtained.

What is claimed is:

1. A papermaking screen comprising:

a first annular supporting member having an outer curved surface, a flat side surface, and a plurality of first recesses formed in the flat side surface and arranged annularly along an entire length thereof, a second annular supporting member having an outer curved surface, a flat side surface, and a plurality of second recesses formed in the flat side surface and arranged annularly along an entire length thereof, said first and second annular supporting members being spaced apart from each other so that the first and second recesses face and correspond to each other, a plurality of space holding members immovably fixed to the first and second annular supporting members and laterally spaced apart from each other to establish a predetermined distance between the first and second annular supporting members, and a plurality of elongated members disposed in and held by the first and second recesses, said elongated members extending parallel to the space holding members and being arranged parallel to each other to form a space between two elongated members situated adjacent to each other, said space forming a slit for screening a paper material.

2. A papermaking screen according to claim 1, wherein each of the space holding members includes a rod immovably fixed to the first and second annular supporting members, and a span holding member covering the rod and abutting against the first and second annular supporting members to keep the distance therebetween.

3. A papermaking screen according to claim 2, wherein a large number of the elongated members is arranged between the first and second annular supporting members relative to a number of the space holding members.

4. A papermaking screen according to claim 1, wherein each of said elongated members is a linear rod located in the first and second recesses.

5. A paper making screen according to claim 1, wherein said first annular supporting member is formed of said outer curved surface, an inner curved surface, and two side surfaces situated between the inner and outer curved surfaces, and said second annular supporting member is formed of said outer curved surface, an inner curved surface and two side surfaces situated between the inner and outer curved surfaces.

6. A papermaking screen comprising:

a first annular supporting member having an outer curved surface, a flat side surface, and a plurality of recesses formed in the flat side surface and arranged annularly along an entire length thereof, a second annular supporting member having an outer curved surface, a flat side surface, and a plurality of recesses formed in the flat side surface facing the first annular supporting member and arranged annularly along an entire length thereof, at least one intermediate supporting member situated between the first and second annular supporting members and formed of inner and outer curved surfaces and two side surfaces situated between the inner and outer curved surfaces, said at least one intermediate supporting member having a plurality of recesses on both side surfaces and arranged annularly along entire lengths thereof, a number of the recesses formed on one side surface of the at least one intermediate supporting member corresponding to a number of the recesses facing thereto, a plurality of space holding members passing through the at least one intermediate supporting member and fixed to the first and second annular supporting members, said space holding members being laterally spaced apart from each other to establish a predetermined distance between the first and second annular supporting members, and first and second elongated member groups formed of a plurality of elongated members extending parallel to the space holding members, the elongated members in the first group being disposed in and held by the recesses in the first annular supporting member and the at least one intermediate supporting member, the elongated members in the second group being disposed in and held by the recesses in the second annular supporting member and the at least one intermediate supporting member, said elongated members in the first and second groups being arranged parallel to each other to form a space between two elongated members situated adjacent to each other, said space forming a slit for screening a paper material.

7. A papermaking screen according to claim 6, wherein each of the space holding members includes a rod immovably fixed to the first and second annular supporting members, and span holding members covering the rod and abutting against the at least one intermediate supporting member to keep the at least one intermediate supporting member away from the first and second annular supporting members.

8. A papermaking screen according to claim 6, further comprising an additional elongated member group formed of a plurality of elongated members, said at least one intermediate supporting member being formed of first and second intermediate supporting members having a plurality of recesses on both sides thereof, said first intermediate supporting member facing the first annular supporting member to hold the first elongated member group therebetween, said second intermediate supporting member facing the second annular supporting member to hold the second elongated member group therebetween, and said additional elongated member group being held between the first and second intermediate supporting members.

9. A papermaking screen according to claim 6, further comprising additional elongated member groups formed of a plurality of elongated members, said at least one intermediate supporting member being formed of at least three intermediate supporting members, each of said additional elongated member groups being situated between two of the at least three intermediate supporting members.

10. A paper making screen according to claim 6, wherein said first annular supporting member is formed of said outer curved surface, an inner curved surface, and two side surfaces situated between the inner and outer curved surfaces, and said second annular supporting member is formed of said outer curved surface, an inner curved surface and two side surfaces situated between the inner and outer curved surfaces.

* * * * *